United States Patent [19]

Sjögren

[11] Patent Number: 4,934,169

[45] Date of Patent: Jun. 19, 1990

[54] METHOD FOR MOVING A TOOL TO EXACT SHAPING OR WORKING ENGAGEMENT WITH A STRIP OF MATERIAL HAVING A REPEATED BASIC SHAPE

[75] Inventor: Börje Sjögren, Huddinge, Sweden

[73] Assignee: Nordisk Kartro AB, Farsta, Sweden

[21] Appl. No.: 192,819

[22] PCT Filed: Aug. 31, 1987

[86] PCT No.: PCT/SE87/00386

§ 371 Date: May 2, 1988

§ 102(e) Date: May 2, 1988

[87] PCT Pub. No.: WO88/02286

PCT Pub. Date: Apr. 7, 1988

[30] Foreign Application Priority Data

Sep. 24, 1986 [SE] Sweden ..... 8604042-5

[51] Int. Cl.[5] ..... B21D 13/02

[52] U.S. Cl. ..... 72/385; 72/15; 72/22; 72/447

[58] Field of Search ..... 72/385, 10, 14.15, 21, 72/447, 22

[56] References Cited

U.S. PATENT DOCUMENTS

| | | | |
|---|---|---|---|
| 1,095,683 | 5/1914 | Stambach . | |
| 3,123,125 | 3/1964 | Lacey, Jr. | 72/385 |
| 3,211,043 | 10/1965 | Sanford . | |
| 3,307,387 | 3/1967 | Lacey, Jr. et al. | 72/385 |
| 3,872,641 | 3/1975 | Falkenberg . | |
| 3,911,773 | 10/1975 | Inowaki . | |
| 3,961,512 | 6/1976 | Mentis . | |

FOREIGN PATENT DOCUMENTS

| | | | |
|---|---|---|---|
| 916905 | 12/1972 | Canada . | |
| 922092 | 3/1973 | Canada . | |
| 0601234 | 8/1934 | Fed. Rep. of Germany | 72/385 |
| 2209272 | 8/1973 | Fed. Rep. of Germany . | |
| 2264309 | 12/1979 | Fed. Rep. of Germany . | |
| 2530188 | 8/1985 | Fed. Rep. of Germany . | |
| 0158836 | 12/1980 | Japan | 72/385 |
| 436687 | 7/1974 | U.S.S.R. . | |
| 126774 | 5/1919 | United Kingdom . | |

*Primary Examiner*—David Jones

*Attorney, Agent, or Firm*—Young & Thompson

[57] ABSTRACT

Method for moving a tool (8) relative to and into engagement with an incrementally advanced metal strip (10) having a repeated basic shape. Between the advancements, the strip (10) is held stationary, so that the tool can be engaged by a movement merely across the strip. The tool is moved to the desired engagement position steered by a basic shape sensor (36) connected to the tool. The sensor locates the exact position of one (48) basic shape spaced from the basic shape (50) intended to be engaged by the tool (8). The tool work stroke perpendicular to the strip is triggered only when the sensor reaches this exact position. A device for practicing the metal comprises a bed (2), a slide (4) slidably mounted on the bed with dies (42, 44) and a tool holder (20) carrying the sensor. Between the tool and dies there is a space for incremental strip advance. The sensor (36) is carried spaced from the tool and locates the exact position of the basic shape (48).

2 Claims, 3 Drawing Sheets

METHOD FOR MOVING A TOOL TO EXACT SHAPING OR WORKING ENGAGEMENT WITH A STRIP OF MATERIAL HAVING A REPEATED BASIC SHAPE

The present invention relates to a method of bringing a tool to a desired engagement position relative to and in engagement with a strip of material which is intermittently advanced in its longitudinal direction past the tool and which has a repeating basic shape, for example in the form of linked, identical products shaped in the strip of material, which cyclically repeat in the longitudinal direction of the strip. The basic shape can be, for example, a plurality of linked identical products made in the strip.

In various fields of manufacture there is a need to efficiently produce a large number of identical products of a certain predetermined shape (cross-sectional shape), said products being linked to each other, for example side by side, and forming a long strip of material; or in other words a strip incorporating the products.

One example of such manufacture is the production of socalled sheet nails in strips, i.e. nails made of profiled sheet metal being parallel to each other and linked via connecting bridges between the longitudinal edges of adjacent nails in the strip. In such a sheet nail strip, the individual nails (=the products) are made with a certain desired profile shape as viewed in cross-section. The nails can be V-shaped in cross-section, for example.

Examples of such sheet nails and strips are disclosed in U.S. patent application Ser. No. 07/053,829, filed May 14, 1987.

In producing linked products in strips with a certain desired final shape of the individual products, the strip (which can be a sheet metal strip for example) is worked and/or shaped sequentially in a number of tool stations arranged in sequence in the direction of movement of the strip.

It is for example possible to produce the basic shape of the product in a first tool station with the aid of a vertically acting shaping punch (i.e. a bending punch) which is repeatedly brought into shaping engagement with the simultaneously incrementally advanced sheet metal strip, so that it is given the repeated basic shape, i.e. a V-shaped. In the following additional working and shaping stations located downline from the first mentioned station in the advancing path of the strip, the products included in the strip can be given a successively more finished shape.

Even if the basic shape of the product in question (which is intended to be produced at a first station) is made with the greatest possible precision and regularity, to among other things, achieve a constant spacing between the products in the strip, it is still not possible in practice to avoid a certain lack of precision in the regular shaping and spacing of the products in the strip. This can be because of variations in the working cycle of the first shaping punch (the bending punch), variations in the incremental advancing of the strip between the basic shaping of two adjacent products in the strip, varying material properties in different portions of the strip, etc. If the following tool stations located downline in the direction of advance of the strip are placed at entirely fixed stationary locations spaced along the strip path, it is not possible to guarantee that the workings or shapings made at these stations will be superimposed on the shape (of the respective product in the strip) already produced upline at the exact intended location of each product. Thus the tool at the downstream workstation in question will at times make its shaping or working stroke at a somewhat misplaced location on the product. The actual tool engagement location will thus often lie somewhat laterally displaced in relation to the exact desired location on the product where the tool should have struck. The reason is that the individual product as a result of the above mentioned variations is not exactly in the position which it would assume if each such variation could be avoided, and this is impossible in practice.

The problem on which the invention is based is thus assuring entirely correct positioning of the tools at the workstations located downline, relative to the basic shapes of the products already produced upline, which shapes have now reached the downline workstation in question where continued shaping or working is to take place. This correct positioning of the tool in question relative to the previously made basic shape in the strip should be able to be achieved regardless of whether there occurs a certain spacing variation or basic shape variation along the strip. The basic idea of the present invention is thus to solve said problem by the downline workstations having a somewhat "floating striking position" in relation to the strip which is stationary immediately prior to and during the shaping or working engagement by each tool. Within the limits of this floating striking position, there can be an automatic correction and adaptive fine adjustment of the tool, so that the tool actually assumes the exact intended engagement position relative to the product in the strip, which is now to be subjected to continued forming or working with the tool in question.

In order to solve said problem, the process according to the invention is characterized in that between the intermittent advances, the strip is held stationary in its longitudinal direction, so that the shaping or working engagement of the tool with the strip can take place through a movement perpendicular to the longitudinal direction of the strip, without moving the tool in the longitudinal direction of the strip, the tool being finely adjusted relative to the basic shape in the strip by being moved to the correct engagement position controlled by at least one basic shape sensor connected to the tool, and preset at a certain space from the tool as viewed in the longitudinal direction of the strip. The control of the tool by the basic shape sensor is achieved by the sensor being made to locate the exact position of one of the cyclically repeated basic shapes in the strip, located one or more basic shape spacings from the basic shape which the tool is to be brought into engagement with. The tool is brought with and steered by the sensor during its precision locating movement in the longitudinal direction of the strip, and the shaping and working movement of the tool perpendicular to the strip is only triggered when the sensor has reached said exact position.

Apparatus for practicing this method comprises a tool bed with dies and a slide supported by the bed and moveable relative thereto on which is arranged a tool holder which supports the tool at a distance from the die, between the tool and the die there being a space for the strip of material through which the strip can be moved by. The tool holder also carries at least one basic shape sensor which is spaced from the tool and is disposed to locate the exact position in the strip of a basic shape spaced from the basic shape which the tool is to engage, fine adjustment of the tool relative to said basic shape being effected by the sensor bringing with it the tool in its precision locating movement along the strip.

In summary the basic principle of the invention can be said to be that the tool "floatingly" arranged in the direction of advance of the strip seeks out its correct engagement position (i.e. adjusts its own position relative to the actual positions of the basic shapes in the strip) by indexing (with the aid of each respective basic shape sensor) on a basic shape (a product) in the strip, lying somewhat downline or upline from the basic shape in the strip which the tool is to come into shaping or working engagement with.

Furthermore, the slide unit is preferably slideably mounted on the tool bed parallel to the advancing direction of the strip of material, there being arranged between the bed and the slide biasing means which strive to return the slide to a balanced starting position when the slide has been displaced therefrom. The biasing means, within the displacement range of the slide, serve to return the slide to a balanced starting position before the subsequent indexing of the tool on the next basic shape (product) as the strip advances. The die means are suitably mounted on the slide, and the tool holder suitably comprises a column mounting, which also supports the basic shape sensor, which is arranged in alignment with, preferably directly above, a counter element arranged on the slide, the sensor and the counter element being on opposite sides of the space for the material strip.

The basic shape sensor can comprise a shape locating means which is displaceable by biasing means arranged in the column mounting to an extended position, where the locating means can be pressed in against the force of the biasing means, said locating means having a configuration corresponding to the basic shape at its end facing the strip space, the counter element also having a configuration conforming to the basic shape, said configuration being complementary to the configuration of the locating means.

In the indexing movement of the locating means seeking the exact position the locating means and the counter element are moved through their respective configuration, from opposite directions to engagement with the basic shape at its deepest point, thus achieving the desired fine adjustment of the locating means and thus the tool relative to the respective basic shape.

In order to simplify the design and improve the reliability of the device, the column mounting can suitably comprise two parallel, spaced columns, the lower ends of which are fixed to the slide and the upper ends of which are received in a platform, which extends transversely over the slide slideable in the tool bed. Both the basic shape sensors and the tool extend downwardly from the underside of the platform, towards cooperating die means arranged on the top of the slide.

The method according to the invention will now be described in more detail below with reference to an illustrative example shown in the accompanying drawings.

Figure 1:
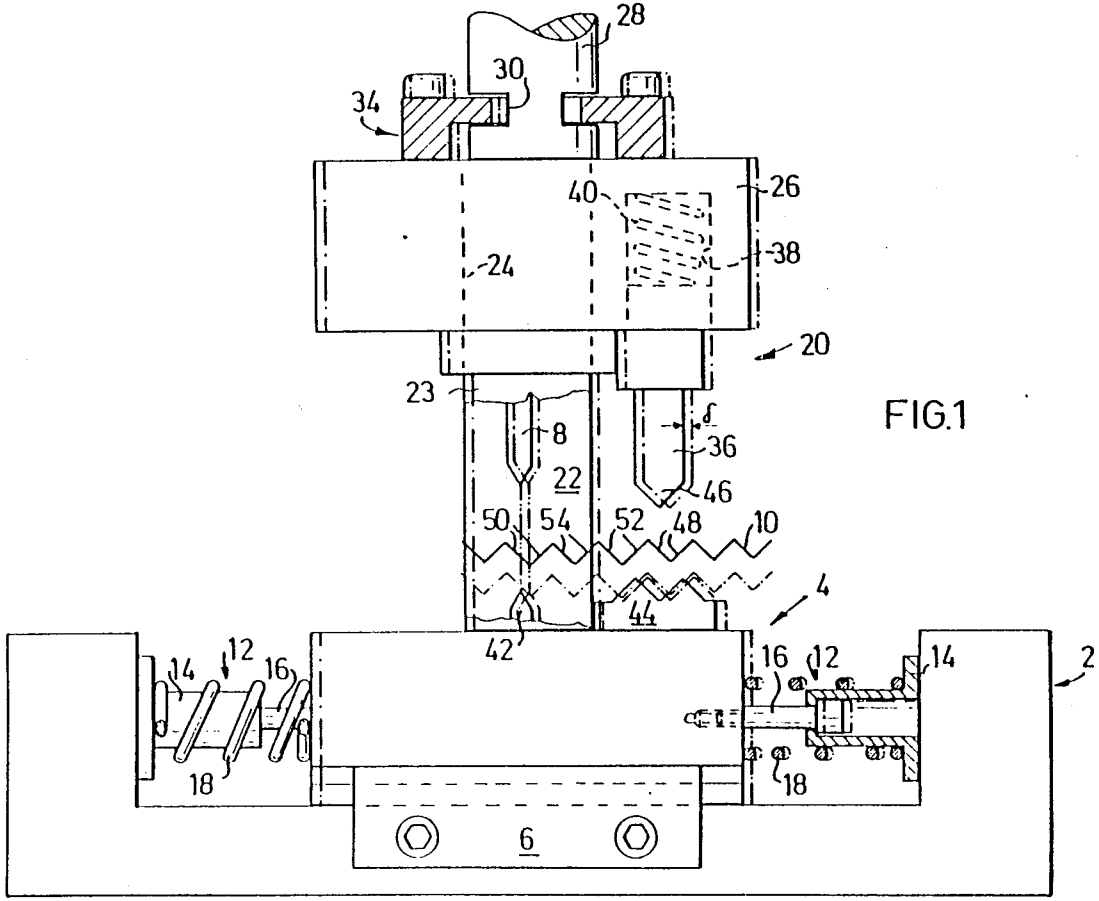
FIG. 1 shows in partial section an elevation of a device according to the invention.
Figure 2:
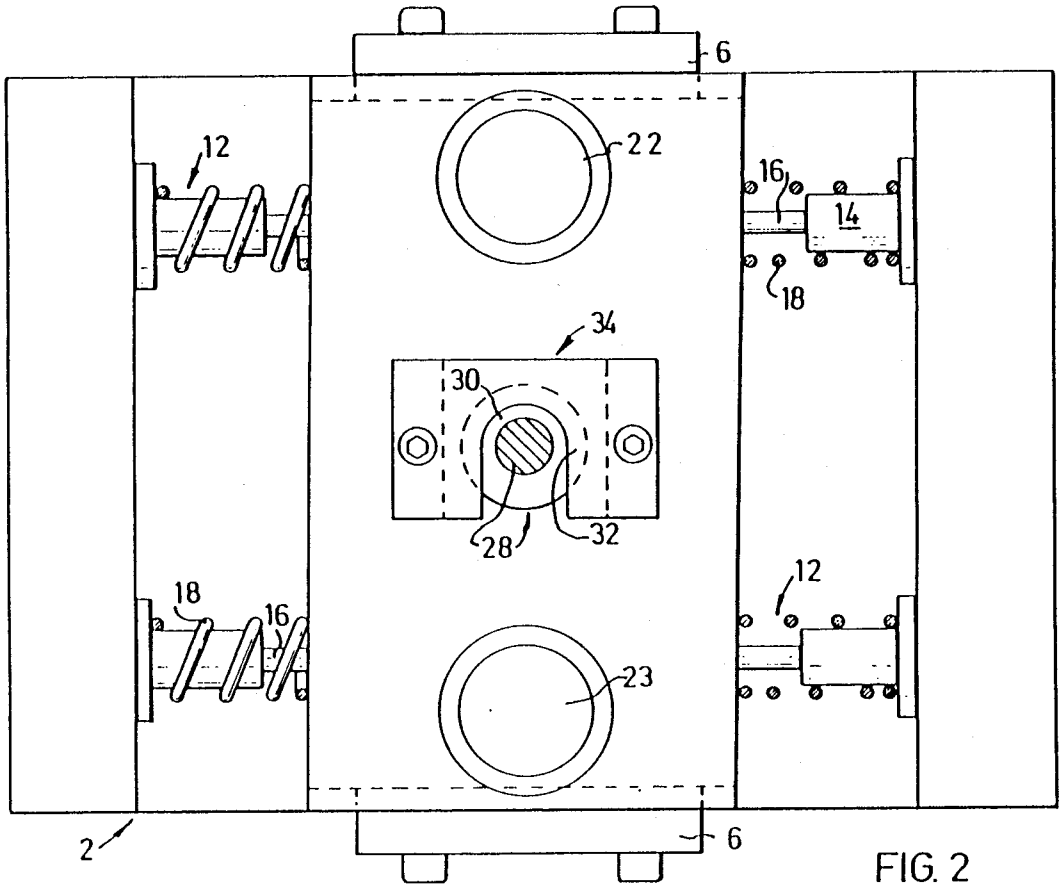
FIG. 2 shows a plan view of the device of FIG. 1.

The device shown in the drawings is intended to provide exact indexing of a tool relative to a basic shape or a product which is included in a strip of material and which is to be subjected to supplementary forming or working with the aid of the tool. The tool is to be moved into engagement with the basic shape in question (the product) which is in the vicinity of the workpoint of the tool. During the shaping or working engagement of the tool with the strip portion in question, the strip is held longitudinally stationary, but after the work stroke of the tool has been completed, the tool is disengaged from the strip, which is then advanced one basic form spacing, so that the next adjacent basic form (product) in the strip can be subjected to the same shaping or working, by the tool performing a new work stroke etc.

The drawing shows a device according to the invention which comprises a horizontally mounted tool bed 2 which supports a slide 4 which is slideably mounted on the bed and is guided longitudinally of the bed by means of a pair of fixed guide rails 6 at the sides of the bed. The slide is slideable on the bed parallel to the direction of movement of the strip of material to be subjected to forming or working by means of the tool, which is exemplified in the drawing by a vertically operating punch 8. The strip is generally designated 10, and is shown in the drawing as a band which upline from the device has already been given a repeating V-shape at a bending station for example. Between the bed 2 and the slide 4 are four spring means 12, each consisting of a sleeve 14 fixed to the bed and in which there slides the head of a bolt 16 screwed into the slide 4. A helical spring 18 is arranged around the sleeve and the bolt and works between the slide and the bed 2. The spring means 12 serve to return the slide 4 to a balanced starting position after the completed stroke of the tool 8 after the fine adjustment of the tool achieved by the device is released as the strip 10 is advanced one step, whereafter there is another fine adjustment of the tool, a new work stroke and so on.

On the slide 4 there is mounted a tool holder in the form of a column mounting 20 comprising two vertical columns 22, 23, the lower ends of which are fixed to the slide and the upper ends of which are received in bores 24 in a platform 26 extending transversely above the slide 4, and spaced above the same. The platform 26 is held in the position shown on the columns by means of a centrally placed carrier rod 28 extending from above, which has a circumferential indentation or groove 30, in which there is received the flange 32 of a holder 34 screwed into the top of the platform. The platform 26 of the column mounting supports a downwardly directed basic form sensor 36 in the form of a downwardly extending shape locator mounted in a bore 38 in the platform 26 and kept extended to its lowermost position by a compression spring 40 in the bore 38.

Directly beneath the tool 8 there is a die 42, in this case in the shape of an upwardly directed die edge mounted on the slide 4. Directly under the sensor 36 there is another die 44, in this case a counter element for the sensor, said die also being fixed to the top of the slide 4. Between on one side tool 8 and the sensor 36 and on the other side the dies 42, 44 there is, as can be seen, a horizontal space for the strip of material 10.

In order to be able to index the laterally adjustable tool 8 relative to the basic shapes in the strip, i.e. in this case relative to the V-shaped, side-by-side linked products in the strip 10, both the lower portion 46 of the sensor 36 and the top of the counter element 44 have configurations conforming to the basic shape, which are mutually complementary and make it possible to press a V-shaped section of the strip between them.

In the very schematic example shown, the fine adjustment of the tool relative to the respective V-shaped in the strip 10 is accomplished by indexing on a V-shape 48 located three spaces downline from the V-shape 50 into which the tool 8 is to be engaged. The drawing shows with solid lines the slide and the column mounting with the tool and sensor when these components are in their rest position prior to fine adjustment of the tool by indexing by means of the sensor. The dash-dot lines show said components after indexing of the tool. The sensor is moved downwards to complete shape engagement with the V-shape 48 at its deepest point, and this means that the sensor 36 and the counter element 44 must be displaced a distance δ0 to the right in FIG. 1. The strip 10 is shown with dash-dot lines when this exact engagement has been achieved. The downward movement of the sensor 36 is achieved by lowering the platform 26 on the columns 22, 23, and this is effected by imparting a downward movement to the carrier rod 28. When the exact shape engagement between the sensor 36, the strip 10 and the counter element 44 has been achieved, thus completing the fine adjustment, the lowering of the platform 26 continues and the sensor 36 is pressed into the bore 38 against the force of the spring 40.

Figure 3:
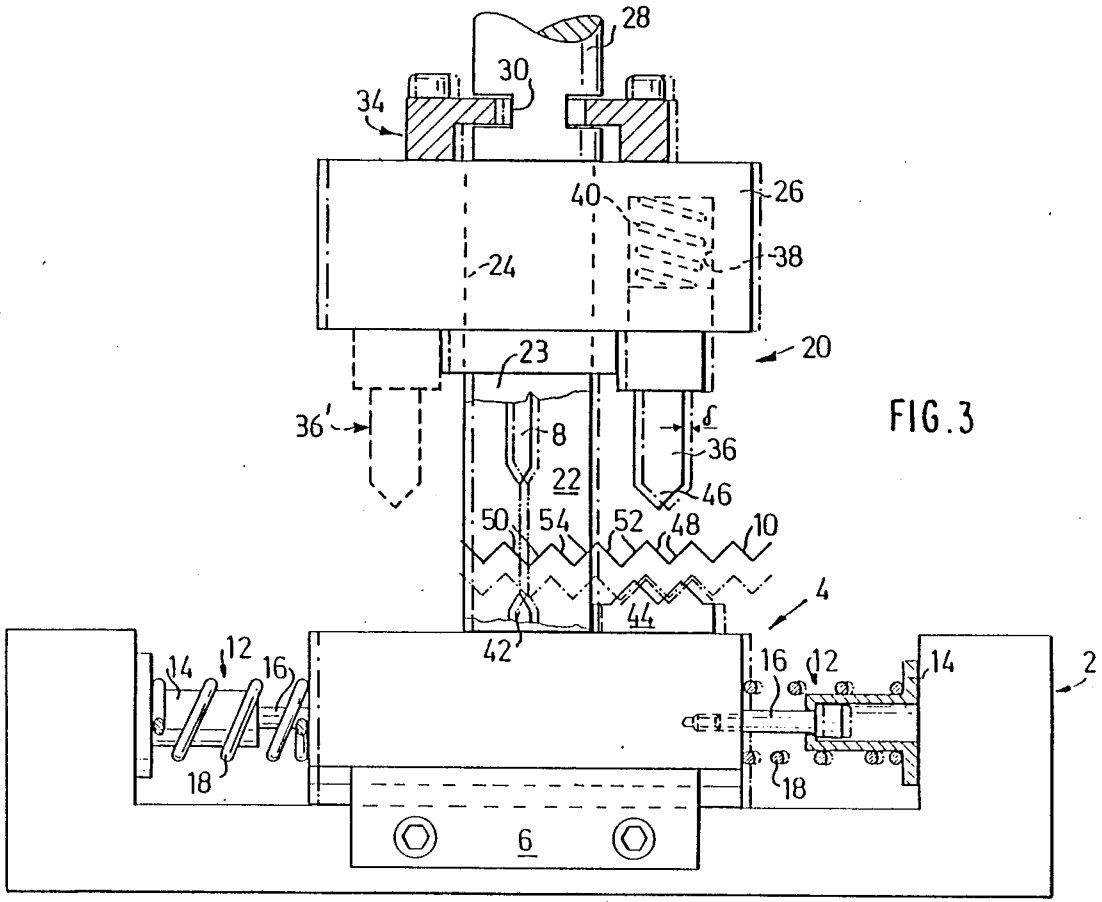
FIG. 3 shows an alternative embodiment of the device shown in FIG 1.

The downwardly directed movement can suitably be accelerated, so that the required striking velocity of the tool 8 is reached when its point engages the bottom of the V-shape 50 which has then been pressed against the die 42, so that the desired tool effect is achieved. In the example shown it is desired to achieve a partial separation of adjacent products in the strip of material. In this case, it means producing sheet nails with cross-sectional upside down V-shape, wherein adjacent nails in the strip are linked to each other via residual bridges (between the longitudinal edges of the nails) at the bottoms of V-shapes 48, 52, 54, 50 etc. FIG. 3 shows another embodiment of the invention, which is identical to that of FIG. 1 and so bears the same reference numerals, except that a second sensor 36' is provided upline of the tool 8 relative to the advance of the strip 10.

I claim:

1. Method of bringing a tool (8) to a desired engagement position relative to and in engagement with a strip of material (10), comprising intermittently advancing a said strip having a repeating basic non-planar shape, in its longitudinal direction past the tool, holding the strip stationary in its longitudinal direction between intermittent advances, so that the shaping or working engagement of the tool with the strip can take place through a movement perpendicular to the longitudinal direction of the strip, finely adjusting the position of the tool relative to a said basic shape in the strip by moving the tool in a direction parallel to the direction of strip advance to a correct engagement position controlled by at least one basic shape sensor (36) connected to the tool, said sensor being spaced at a specific distance from the tool as viewed in the longitudinal direction of the strip; and controlling the position of the tool in said direction parallel to the direction of strip advance by the position of the basic shape sensor to locate the exact position of one (48) of the cyclically repeated basic shapes in the strip, located one or more basic shape spacings from the basic shape (50) with which the tool (8) is to be brought into engagement, said tool being moved with and steered by the sensor during its precision locating movement in the longitudinal direction of the strip; and effecting the shaping and working movement of the tool perpendicular to the strip only when the sensor has reached said exact position.

2. Method according to claim 1, wherein the fine adjustment of the tool relative to the basic shape in the strip is controlled by at least two basic shape sensors (36, 36') connected to the tool (8), at least one (36') of which is disposed upline and another (36) downline of the tool (8), relative to the advance of the strip (10).

* * * * *